US005680893A

United States Patent [19]

Neer

[11] Patent Number: 5,680,893

[45] Date of Patent: Oct. 28, 1997

[54] DECORATIVE PRIVACY SCREEN

[76] Inventor: Dana L. Neer, P.O. Box 75323, Tampa, Fla. 33675

[21] Appl. No.: 592,262

[22] Filed: Jan. 26, 1996

[51] Int. Cl.[6] ..... A47H 1/00

[52] U.S. Cl. ..... 160/330; 160/DIG. 7

[58] Field of Search ..... 160/330, 345, 160/DIG. 7, 237, 123, 124, 126, 327, 341, 354, 368.1, 405

[56] References Cited

U.S. PATENT DOCUMENTS

| | | | |
|---|---|---|---|
| 4,091,857 | 5/1978 | Jacobs | 160/330 |
| 4,166,494 | 9/1979 | Utting | 160/330 |
| 4,188,991 | 2/1980 | Boyle | 160/330 X |
| 4,391,865 | 7/1983 | Constance | 160/330 X |
| 4,576,904 | 3/1986 | Anitole | 430/347 |
| 4,868,019 | 9/1989 | Knickerbocker | 428/17 |
| 5,043,202 | 8/1991 | Knickerbocker | 428/195 |
| 5,116,056 | 5/1992 | Schmutte | 160/330 X |
| 5,217,057 | 6/1993 | Hubbard et al. | 160/345 |
| 5,443,563 | 8/1995 | Hindel et al. | 160/DIG. 7 X |

*Primary Examiner*—David M. Purol

*Attorney, Agent, or Firm*—Stein, Pendorf & Van Der Wall

[57] ABSTRACT

A device and assembly for screening an area from view. Specifically, an aesthetically pleasing decorated screen or panel for proving privacy to an area such as a pool, patio or lanai. The privacy screen assembly is readily adapted to the geographical location of the purchaser, the intended area to be screened, and the overall amount of privacy which is desired.

19 Claims, 6 Drawing Sheets

DECORATIVE PRIVACY SCREEN

BACKGROUND OF THE INVENTION

1. Field of the Invention

The present invention concerns a device and assembly for screening an area from view as desired to thereby increase privacy, and in particular, to a decorated screen or panel which may be easily deployed or retracted to screen an area such as a pool, patio or lanai from view. The decorative screen is useful both for aesthetic and privacy considerations. The decorative screen is easy to install, sturdy, readily disengaged, and easy to operate.

2. Description of the Related Art

In cities, and even some more rural settings, personal privacy is often difficult to maintain. As land use restrictions increase and the size of the average house lot decreases solitude becomes a premium for the homeowner or apartment tenant. Specifically, a homeowner may want to enjoy his or her backyard patio or pool only to find that the neighbors have a clear vantage of the homeowner's activities. These "intrusions" are compounded if the homeowner or tenant lives along the water, a golf course or other area with heavy traffic.

For example, many luxury homes are constructed along golf courses. For the homeowner, one of the enticements for purchasing the home was its location and view. However, golfers while walking along the fairway or chasing after a stray golfball can often literally look into the home's kitchen, patio, or pool area. Additionally, these encroachments by passersby can occur at lake homes, at homes along waterways or rivers and even at restaurants with outdoor eating areas. However, the need for privacy is probably most felt those individuals who live in close proximity to one another such as residents of newer housing developments, townhouse or condominium owners and apartment tenants.

A homeowner or renter who desires to increase the privacy around their pool, patio or home has few options. Installation of solid fencing or a pool and patio enclosure is not only expensive but can result in the loss of view, loss of the pleasant breeze or loss of the feeling of being outdoors. Homeowners or renters who enjoy the benefits of an outdoor pool area are unlikely to be content with the cumbersome, unattractive, fixed, and generally ill-suited alternatives currently available to provide some privacy to an open-air area.

Historically, fabric structures, enclosures, screens and fences have been used for a variety of applications. Large fabric domes cover outdoor arenas, shopping malls, swimming pools, tennis courts and other locations having a need for a customized shelter. However, due to their size and complexity fabric domes are not well-suited for an individual homeowner, especially if the area sought to be enclosed is small or has some type of overhang. Additionally, a dome structure is not well adapted to ensure privacy. Specifically, to provide sufficient seclusion for a porch or patio the perimeter of the dome would have to extend down to such an extent that the patio would essentially be enveloped by the structure.

A current practice, most often utilized for above ground swimming pools or hot tubs, is to build a semi-permanent enclosure made up of vertical sidewalls including a fence-like portion and a ventilating window portion. For instance, U.S. Pat. No. 4,901,484 (Santosuosso) teaches a swimming pool enclosure which is constructed to overlie and completely enclose a swimming pool and surrounding a planar structural deck surface area. The enclosure structure is designed to be a permanent structure and therefore utilizes support channels bored into the concrete deck. Additionally, since the enclosure is intended to extend the usable season for an above-ground swimming pool, a complex roof support framework and cover is required.

Additionally, U.S. Pat. No. 5,148,646 (Lutostanski) teaches a convertible enclosure adapted to cover an outside hot tub installation. Due to its intended function, i.e. enclosing a hot tub or spa during inclement weather, the invention of Lutostanski requires an overhead support skeleton capable of supporting a durable, weatherproof vinyl cover.

An alternative approach, in warmer climates, is to install screen material at the base of the pool enclosure. This screen material is a fiberglass screen with an opaque or frosted vinyl, for instance FLORIDA SCREEN. However basic screen materials have no distinctive decorative pattern and due to the thickness and opacity of the vinyl coating individuals utilizing the pool area have a restricted view.

Both of these structures serve to increase the overall length or season which an outdoor swimming pool or hot tub may be used. Therefore, these enclosures are constructed to provide cover and be generally weather proof. Accordingly, heavy plastic, vinyl, glass or plexiglass are utilized in construction. Due to the requirements that the structural cover be weather proof and wind tight the enclosures do not address the need for providing the amount of privacy required by the homeowner.

The foregoing examples cover the pool or patio area thereby hindering the breeze and more particularly sunshine from reaching those utilizing the outside area. Likewise, a canopy or awning provides excessive shade without privacy from onlookers.

Individual or module privacy screens are well-known. However, these screens are intended for use indoors, specifically in an office environment. See for instance U.S. Pat. No. 5,287,909 (King et al.) which relates to freestanding privacy screens shaped to be positioned in a side-by-side relationship. These modular screens are designed to form office cubicles and are characterized by their substantial, solid construction.

Historically, fences have been a favored approached to provide isolation from ones neighbors or passersby. However, typical fences utilizing wood or metal in construction have several inherent disadvantages. First, building a fence substantial enough to provide privacy is expensive. Second, communities often have zoning and deed restrictions regarding the height and materials permitted in permanent fencing. Third, traditional fencing is fixed, often unattractive, and impedes the view of the persons utilizing the outside area. Lastly, construction of permanent fencing can be offensive to or perceived as creating a personal barrier between a homeowner and their neighbors and community.

Alternatively, flexible fencing products are known, including those utilizing an "open" or mesh like construction. Specifically, these fencing materials have been utilized most often as snow fencing or for erosion control purposes. Alternatively, flexible fencing products have been utilized as yard fencing, as a wind screen, or to serve as guide markers on ski trails and direct ski traffic. Occasionally, especially when used in snow or other light environments the fencing material may be impregnated with an elastomeric composition containing a pigment (most notably blaze orange). These types of flexible fences are unattractive, unstable at the height required to meet the present need, fixed, and do not provide sufficient privacy to an individual or group utilizing an outdoor area.

Landscaping is often used as an alternative means of providing privacy around a home, pool or patio area. However, shrubs and bushes take an extended growing period in order to a reach sufficient height or density to provide privacy. In addition, landscaping is often expensive and requires the homeowner have time to care for the plants.

All of the above-mentioned enclosures, covers, or fencing approaches suffer from disadvantages which limit their usefulness and applicability to the present need. Specifically, unsightliness, mechanical complexity, difficulty in use and high cost. For the foregoing reasons, there is a need for a low cost, simply constructed, attractive, and retractable decorative screen to increase privacy around a pool or patio area as needed.

SUMMARY OF THE INVENTION

In view of the foregoing disadvantages inherent in current enclosure and fencing devices, specifically the absence of aesthetically pleasing means of providing privacy, it is an object of the present invention to provide an artistic and visually pleasing means by which a pool area, patio, lanai, or any exposed area can be screened to increase privacy.

It is a further object to provide an artistic means and system to screen an exposed area which is readily tailorable to the geographical location of the purchaser, the intended area to be screened, and the overall amount of privacy which is desired.

It is a further object to provide an artistic means and system to screen an outside area, particularly the area around a pool or patio, which is customizable to the taste of the consumer. For instance, the purchaser may choose the overall layout, pattern and complexity of the design to be applied to the decorative screen.

It is a further object to provide an artistic means and system to screen an outside area which preserves the ability of the homeowner to look out at the surrounding scenery through the screen while simultaneously greatly limiting the ability of persons on the outside from seeing into the enclosed area.

It is a further object to provide an artistic means and system to screen an outside area which may be releasably fixed in a hanging/taut position or drawn depending on the privacy needs of the user.

It is a further object to provide an artistic means and system to screen an outside area which may utilize either a freestanding installation or may retrofit a current enclosure means, easily conforms to conventional outdoor hardware dimensions, and will be readily adopted in the market as a means for enclosing a patio or pool area to increase privacy.

It is a further object to provide an artistic means and system to screen an outside area which will allow moderate wind, rain, or weather elements to pass through the screen without undo stress on the screen assembly framing, screen or attachment hardware.

After extensive investigation and experimentation, the present inventor has found that these and other objects are accomplished by providing a decorated screen in a screen assembly system which is comprised of a coated open weave fabric, which can be installed around a pool, patio, porch or lanai area, which combines weather resistance and ease of installation, and which is characterized by the application of a customizable design or pattern of varying complexity and thickness to increase privacy.

A significant feature of the present invention resides in the use of a base screen material, preferably a polyvinyl chloride (hereafter PVC) coated fiberglass screen fabric which permits the application and retention of a colorfast pigment such as a PVC plastisol ultraviolet resistant coating in a reflected pattern or scene of sufficient complexity and image intensity to create an opaque quality and provide privacy to those behind the decorated screen. The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying of designing other decorative screen assemblies for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

Further objectives and advantages of the present invention will become apparent from a careful reading of the detailed description provided hereinbelow, with appropriate reference to the accompanying drawings.

DETAILED DESCRIPTION OF THE INVENTION

Figure 1:
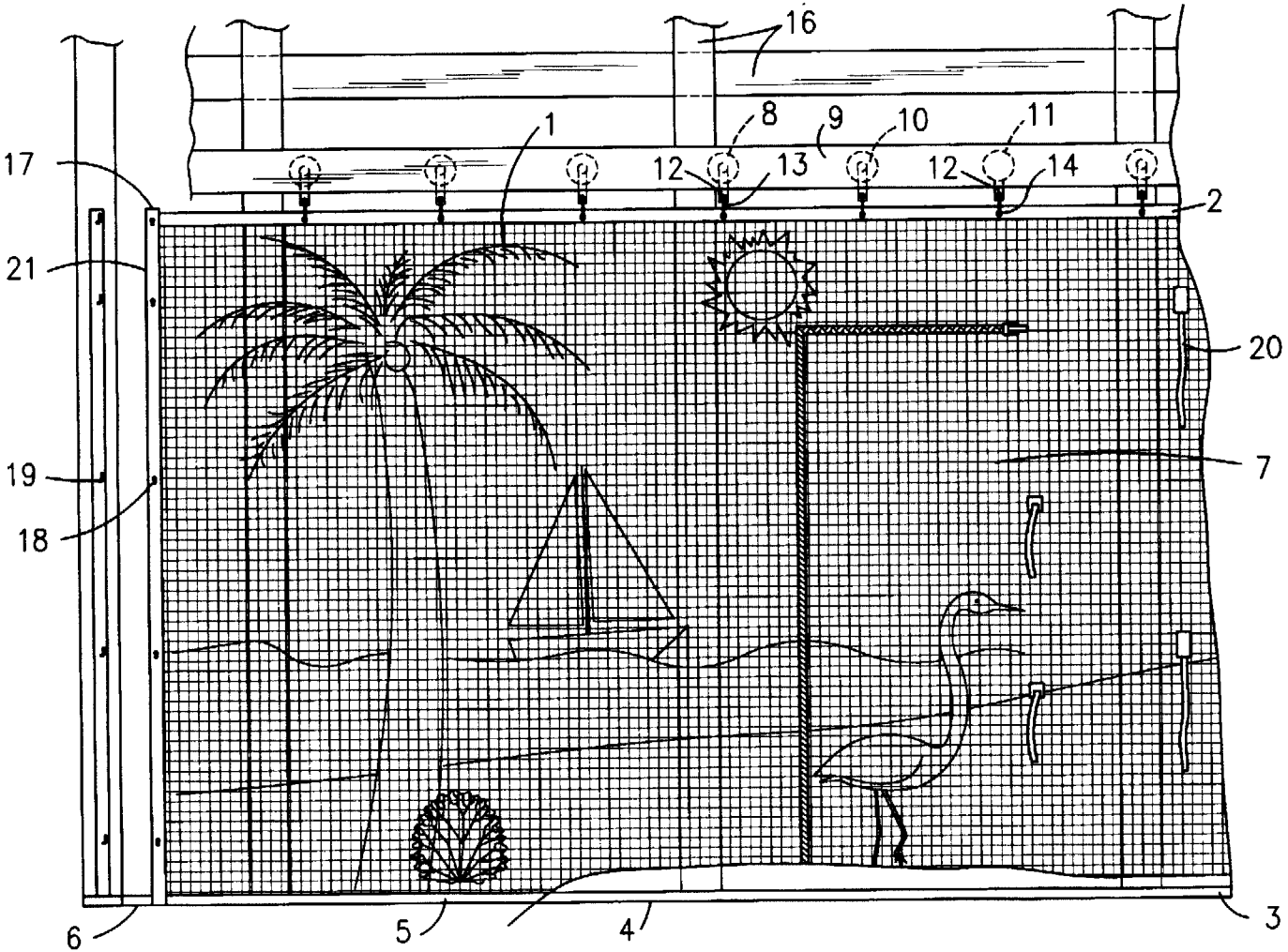
FIG. 1 is a plain view of a first embodiment of a decorative screen assembly, with the screen in an extended position, hung from a track installation.

After extensive investigation, the present inventor has discovered that an artistic means and system to screen an outside area such as a patio, pool, or lanai for increased privacy may be constructed from a decorated screen material incorporated into a screen assembly system. More particularly, a fiberglass screen base material is decorated by application of a decorative pigmented coating. The decoration consists of a customizable reflected pattern chosen by the consumer. The consumer is able to specify the amount of privacy ultimately to be afforded by the decorative screen by varying the thickness, pigment color, and complexity in design of the materials applied.

The base screen material for the decorative privacy screen is preferably fabricated from an impregnated or coated woven or mesh fencing or screen product. The base screen material may be purchased either precoated or in a uncoated condition. Preferably, a substantially "open" weave pattern of a suitable fiber such as nylon (for instance a 70 denier nylon Raschel knit substrate having a mesh size of approximately 1/10 to 1/30 inch opening), polyester, fiberglass or the like is impregnated or coated with an elastomeric polymer such as PVC. The open weave pattern may be either uniform, a heavier denser weave in those areas of the screen which may require reinforcement or utilize variable mesh sizes to form texture. Base screen materials are generally manufactured in monochromatic hues such as black, white, gray, charcoal, dark green, bronze or aquamarine. However, the consumer may select any base hue desired. Overall, to be durable, the base screen material must be resistant to water, mildew, abrasion and ultra-violet light degradation, be somewhat lightweight to facilitate use in a screen assembly system, and be capable of being painted or coated with a decorative pattern.

The base material is preferably a vinyl coated fiberglass screen material. Several vinyl coated fiberglass screen materials and equivalents, which may serve as a base for the decorative screen, are currently available commercially. For instance SOLAR VUE manufactured by CCX Fiberglass Products, Walterboro, S.C. is suitable. Traditionally, these vinyl coated fiberglass screen materials are utilized in above-ground pool enclosures. Current vinyl coated fiberglass screen materials are traditionally monochromatic and add minimal value in regard to privacy. An onlooker can look through a monochromatic screen and readily ascertain the presence and activity of those behind the enclosure.

The weave gauge of the mesh in the base screen material should fall within the range of 10 vertical and 15 horizontal strands per square inch to 25 vertical and 35 horizontal stands per square inch, more preferably 16×18 to 20×30 strands per square inch.

An additional advantage of the decorative privacy screen, in addition to increased privacy, is that the underlying base materials help reduce noise transmission, solar heat and glare.

Most colors seen in ordinary experience are caused by the partial absorption of white light. The pigments that give color to most objects absorb certain wavelengths of white light and reflect or transmit others, producing the color sensation of the unabsorbed light. In the present invention, the amount of privacy afforded by the decorative screen depends on the choice of colors in the decorative pattern and the characteristics of light.

That is, it is possible for the human eye to discern scenery behind a hung screen, particularly if the screen is monochromatic and if the screen is not illuminated, e.g., by sunlight in the daytime or by house illumination lights at night. Once the screen is illuminated, it becomes more difficult to discern details of the scenery behind the screen, but it still generally remains possible to discern scenery behind the screen, particularly if the scenery behind the screen is well illuminated (i.e., if the amount of light transmitted from the scene thorough the screen to the observer is significant compared to the amount of light reflected from the viewer's side back to the viewer).

Discerning the scenery behind a screen becomes more difficult if the screen is provided with a pattern. That is, the eye has difficulty discerning between the pattern on the screen and the pattern of the scenery behind the screen. The greater the contrast in light reflectance or color brightness in the pattern, the greater the obfuscation of the scenery. Additionally, the pattern applied to the decorative screen will capture the interest of a bystander or viewer thereby limiting their interest in the activity of those behind the decorative screen.

Another way in which a screen may mask or camouflage a screen is if the amount of light transmitted through the screen is varied in a camouflaging pattern. That is, if light transmitted from the scenery through the screen to the viewer is patchy and not uniform across a plane perpendicular to the viewer, discrimination of the scenery behind the screen is difficult.

Coatings are colored by the addition of dispersed pigments. In the present invention a high degree of color contrast and light reflectance is desired in the chosen decorative pattern. Specifically, the degree of privacy for those inside the decorative screen enclosure assembly is directly related to the 1) custom color pattern ordered and the amount of surface area covered by that decorative pattern, 2) the density and thickness of the coating material, 3) the gloss level, uniformity and sheen of the coating material and 4) the gauge of the mesh chosen as the underlying base screen material. The reflectance depends on the lightness/brightness of the colors chosen to comprise the decorative pattern and the overall glossiness of the decorative pattern. Transmissiveness depends on the gauge size of the mesh in the chosen base material and the thickness of the decorative materials which comprise the decorative pattern.

The amount of light reflected, i.e., reflectivity, depends on the ratio of the refractive indexes for the two media. The plane of incidence contains the incident ray and the normal (line perpendicular) to the surface at the point of incidence. The angle of incidence (reflection or refraction) is the angle between the incident (reflected or refracted) ray and this normal. The laws of reflection state that the angle of incidence is equal to the angle of reflection and that the incident ray, the reflected ray, and the normal to the surface at the point of incidence all lie in the same plane. If the surface of the second medium is smooth or polished it may act as a mirror and produce a reflected image. If the "mirror" is flat, or plane, the image of the object appears to lie behind the mirror at a distance equal to the distance between the object and the surface of the mirror. A light source is the object A, and a point on A sends out rays in all directions. The two rays that strike the mirrored surface at B and C, for example, are reflected as the rays BD and CE. To an observer in front of the mirrored surface, these rays appear to come from the point F behind the mirror. It follows from the laws of reflection that CF and BF form the same angle with the surface of the mirror as do AC and AB. If the surface of the second medium is rough, then normals to various points of the surface lie in random directions. In that case, rays that may lie in the same plane when they emerge from a point source nevertheless lie in random planes of incidence, and therefore of reflection, and are scattered and cannot form an image.

In a further refinement, the dispersed pigments chosen may be light colored contrasting with dark colored, or have light reflective properties contrasting with light absorptive properties so that ambient light will be reflected off of the decorative screen thereby decreasing the likelihood that an onlooker would be capable of viewing activities or persons behind the screen.

Specifically, since the inside of the decorative screen (the side which requires privacy) is darker (less sunlight due to background of house, roof over pool, etc.) the users of the screen can readily look out through the screen material to the brighter environment. On the other hand, those on the outside of the screen perceive light reflected from the decorative pattern, but have difficulty seeing the relatively smaller amount of light transmitted through the decorative screen, and are thus unable to ascertain activity or persons behind the screen.

As a further teaching of light perception and camouflage systems, see U.S. Pat. No. 4,868,019 which teaches an improved camouflage system for concealing people and objects from animals. The system is based in part on the neutral value scale, in which a color is evaluated based on its reflectivity, rather than its associated hue. The techniques utilized in the selection of base and contrast hues to increase camouflage could be utilized in the construction of a decorative privacy screen according to the present invention.

Further examples of camouflage techniques are disclosed by the following U.S. Patents the disclosures of which are incorporated herein by reference:

| | |
|---|---|
| 4,576,904 | METHOD FOR DEVELOPING NATURAL CAMOUFLAGE PATTERNS |
| 5,043,202 | CAMOUFLAGE SYSTEM AND MATERIAL USING THREE REFLECTIVE LEVELS |

The screen assembly system of the present invention must be durable enough to withstand varying weather elements. In particular, the secondary coating(s) which form the decorative pattern must be applied to the base screen material in such a manner that it will withstand chipping, peeling or fading. Durability of the applied pattern may be increased by ensuring a good coating adhesion between the decorative pattern coating material and the substrate material. The decorative coating or paint materials should wet the substrate. Wettability is determined by the difference between the surface tension of the liquid coating and the surface energy of the solid substrate. The coating viscosity must be low enough to allow the coating to flow. Usually the coating material is applied by some mechanical means, and thus is spread over the surface by the mechanical forces acting during coating. If the surface energies are not favorable for wetting, the coating will recede from the substrate. In the present invention, the surface tension of the chosen coating material should be lower than the critical surface tension of the chosen solid substrate base material. Optionally, the base screen material may be pre-treated with a wetting agent or include a wetting agent in the paint itself.

Numerous spray-paints and coating materials suitable for plastics are available. Such coatings may be solventborne, waterborne, high solids, or 100% reactive solids. The coating material may be chosen from a pigmented polymerized or copolymerized vinyl chloride resin, plasticized with phosphate or phthalate ester plasticizers or equivalent plasticizer compounds. Alternatively, acrylic enamel may be utilized in the decorative coating of the underlying PVC coated base material.

Preferably, the thickness of the decorative coating should fall within the range of 25 to 125 microns.

In a further refinement to the present invention, the material utilized for the screen fabric as well as the coating and paint material may allow passage of light within the UV-A band to allow for sunbathing while utilizing the privacy screen.

In a further refinement, the materials utilized in the application of the decorative design may be treated with fungicide and ultraviolet inhibitors. Lastly, the coating materials may be cured according to manufacturer's specification.

Paint and other coatings are applied to plastic surfaces by many different techniques. The choice of techniques is determined by the geometry of the plastic material to be coated, the type of coating used (especially its viscosity) and the coating thickness required.

Spraying is the method most often used to coat plastic materials and is a preferred application means in the present invention. Depending on the specification of the end consumer, the decorative coating may be applied on either the outside of the decorative screen or alternatively on both the inside and outside. Spraying may be carried out manually by small hand-held spray guns, or automatically in large installations. Spraying equipment may be categorized as air-spraying heads, airless spraying heads, air-assisted airless, centrifugal spraying disks and cones and electrostatically assisted spraying heads. Preferably, the decorative pattern will be applied to the base screen material by means of a air atomization (airbrush). Use of hand-held airbrushes allows the coating material to be applied over a specific surface area in a custom, artistic design. Spraying equipment suitable for applying a decorative secondary coating to a base screen material are well known to those in the plastics and coatings industries. See specifically, Berins, M. L. Ed., *Plastics Engineering Handbook of the Society Plastics Industry, Inc. 5th Edition* N.Y., Van Nostrand Reinhold, 1991 pp. 782–285. ISBN 0-442-31799-9 incorporated herein by reference.

Because the decorative screen assembly of the present invention is designed be custom applied to the specifications of the homeowner, the number of design patterns possible is essentially limitless. The color of the base screen material may be matched to the exterior color of the owners home or be selected from any of the industry standard colors. For instance, a homeowner may chose the emblem of a local sports team as a pattern or a scenic design which would blend with the surrounding area. Optionally, a brick or fence pattern, a pool area or house with no individuals present, a Caribbean setting, a New York skyline, shrubs, trees, flamingos, flowers, or a favorite image may be applied as the decorative pattern. Care should be taken by the consumer when selecting the decorative pattern to be applied to ensure that the image is not so garish as to be offensive.

Alternatively, the decorative pattern coating may be applied by curtain coating, screen printing or flexographic printing.

In a further refinement to the screen assembly system of the present invention small weathertight lights may be incorporated into the screen at the top or bottom edge of the decorative screen from the outside, thereby offsetting any shadow cast by an individual positioned between the household lights and the decorative screen.

Any mechanism known in the patio framing/fencing industry may be utilized for the frame means and attachment means by which the decorative screen is secured to the porch, patio, deck, or pool area. Preferably, the frame means is constructed with multiple parallel vertical support posts or poles which define a roughly rectangular area and are spaced at intervals far enough apart to receive and support a decorative screen.

Because the decorative screen and screen assembly system of the current invention is intended to be customized to the specifications of the homeowner the system can be installed at any height or length desired. The decorative screen of the present invention can be affixed within a frame support, whether designed for the particular decorative screen or by modifying an existing enclosure structure. The decorative screen, having a top and bottom edges, may be hung by its top edge from a cable, track system or rod.

The attachment means by which the screen is suspended may utilize hooks, clamps, or any hanging hardware which would permit the decorative screen to be uniaxially movable (i.e. slide) within the overhead frame. The decorative curtain can be suspended in a manner similar to a curtain, panel, or on a roller system. In a further refinement the suspending hardware and frame materials are weather-resistant to allow the framing and hardware to remain out-of-doors year round without corroding or otherwise degrading. In a still further refinement, the hooks, clamps, or hanging hardware have a release mechanism whereby the decorative screen will disengage from the supporting frame structure during high winds or inclement weather, thereby preventing damage to the screen assembly system.

The hanging hardware release mechanism may utilize magnets, snaps, VELCRO, or any means which would allow the decorative screen to detach from the hanging hardware and frame support during a high wind. Additionally, the lower edge of the screen may have incorporated therein releasable fasteners such as VELCRO, magnets, or snaps which would permit the screen to disengage from the frame means during inclement weather. Preferably the release fasteners have a release pressure of 2 pounds or less, however this pressure may vary given the dimensions of the privacy screen assembly and the general weather conditions of the local in which the privacy screen assembly is utilized.

In a alternative embodiment the decorative screen and screen assembly of the present invention may be free standing. Utilizing this embodiment the decorative screen may be installed around a swimming pool, patio or lanai by connecting it to poles or stanchions attached to or embedded in the ground or deck area surrounding the area to be screened. If desired, this installation embodiment can be reinforced by cables or rods at the top and bottom edges of the decorative curtain.

The decorative screen may incorporate numerous features to increase its usefulness and extend its longevity. For instance, the screen may include a rigid member at its distal end (leading or left edge) to help maintain the screen shape and aid in positioning the screen within a track. Additionally, the top edge of the screen may contain a reinforced portion to prevent wear-and-tear between the hanging hardware/suspension means and the decorative screen itself. The top edge of the decorative screen material may have opening or eyelets defined therein to facilitate suspension from the installation hardware. The openings or eyelets may be cut, glued, sewn or heat welded along the entire length of the screen.

The device and system according to the present invention will now be discussed in greater detail by reference to the drawings.

FIG. 1 illustrates a first embodiment of the present invention. Specifically, a view of the decorative privacy curtain from the inside perspective of the screen assembly system (i.e., from poolside). The screen assembly system assembly includes a screen 1 with vinyl or otherwise reinforced top and bottom edges (2 and 3 respectively). The top edge 2 may have defined therein grommets 4, to facilitate suspension from a track 9. The bottom edge of the screen which may incorporate several releasable fasteners, i.e., covered magnets 5, which serve to secure the bottom edge of the screen against a flat metal bar 6 which may be attached to the base of the screen assembly system. The decorative screen is suspended from an overhead track 9 by a sliding mechanism 8. The sliding mechanism 8 may consist of rollers 10 or alternatively rigid TEFLON sliding retainers 11. The sliding mechanism 8 has joined to it an extension arm 12 which extends below the lower edge of the overhead rod, or alternatively through a slot defined in the track, and is adapted to receive a hook or clip 13 whereby the decorative screen may be attached to the sliding mechanism in the track assembly. The track 9 may be attached to or modify a pre-existing pool enclosure frame 16. Multiple decorative screens may be utilized to screen off one or more sides of an area to be enclosed.

When the decorative screen is not in use or in its full extended position, the screen material may be secured out of the way by use of a tie-back 20 at the proximal or right edge of the screen. When the decorative screen is in its extended position a rigid member 17 incorporated in the distal edge (left edge) 21 of the screen helps add support to the screen and may have formed therein 18 means to secure the distal edge or the screen to a stationary object 19.

In a further refinement, the screen 1 may have a door 7 incorporated therein such that the screen may remain in its "extended" position while permitting ready passage between the interior and the exterior of the screen assembly.

Figure 2:
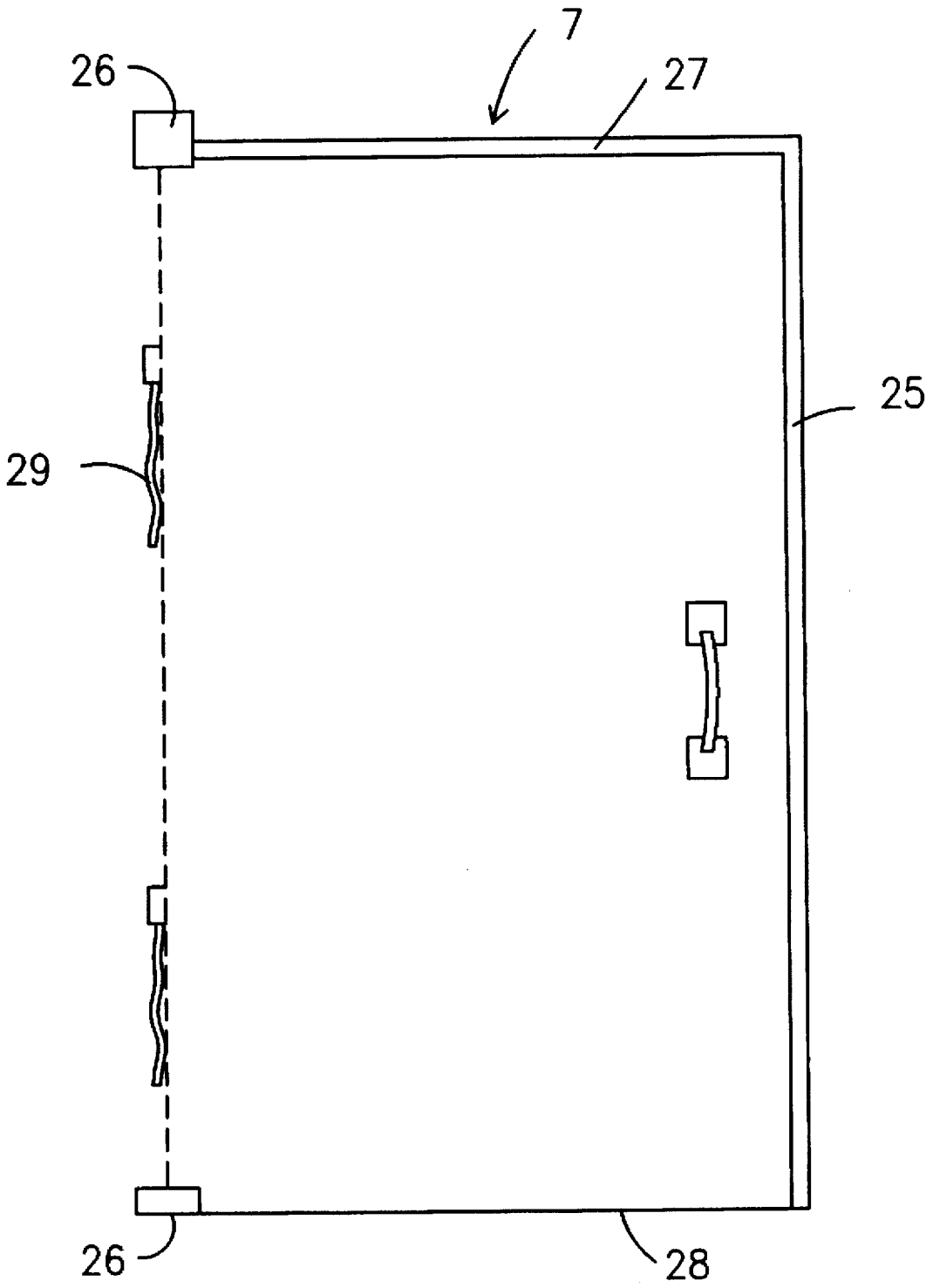
FIG. 2 is a plain view of a door as shown in FIG. 1.

FIG. 2 illustrates possible construction modifications to the door 7 defined in the screen. Specifically, the door may include a vinyl or equivalent reinforced perimeter 25 which can be fastened by means of a zipper, hook-and-loop fastener (VELCRO), or any type of snapping system. The door and its accompanying reinforcement can be formed from a single piece or alternatively cut and sized to fit and thereafter glued, sewn or heat welded onto the screen. At the upper 27 and lower 28 edge of the door there is an extended reinforced area 26 which helps prevent the decorative screen from tearing upon repeated use of the door. When the door is not in use, or to maintain the door in an open position door tie-backs 29 may be utilized.

Figure 3:
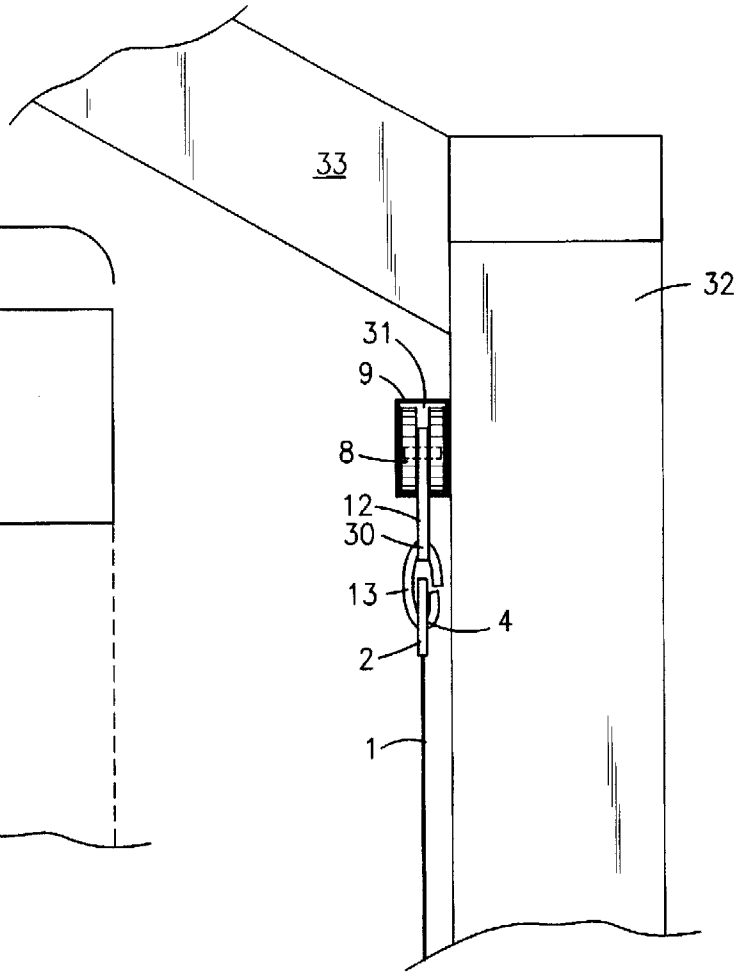
FIG. 3 is a cross-sectional view of a first screen hanging installation embodiment.
Figure 4:
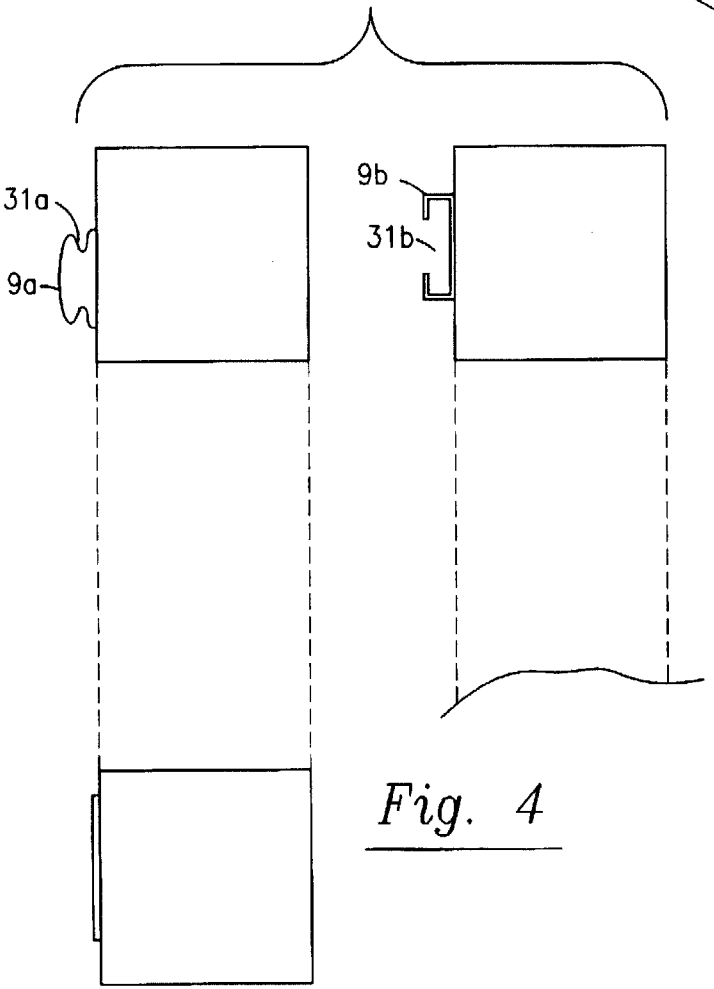
FIG. 4 is a cross-sectional view of a first screen installment embodiment illustrating the ingress in the track.

FIG. 3 illustrates a cross-sectional view of the attachment means by which the decorative screen may be hung. The decorative screen 1 is suspended by passing a hook 13 through both a grommet 4 defined in the reinforced top edge 2 the decorative screen and a aperture 30 formed in extension arm 12. The extension arm 12 is joined to the sliding mechanism 8. The sliding mechanism 8 is housed in an ingress 31 in the overhead track 9. The ingress 31 defined in the track may entirely encase the sliding mechanism or as further illustrated by FIG. 4 the ingress **31*a* and 31*b* defined in the track 9*a* and 9*b* may only partially encase the sliding mechanism 8. The later approach may facilitate removal of the decorative screen from the overhead track for storage or repair. The track 9 may be affixed to various support posts 32 and trusses 33** of a pre-existing enclosure or alternatively to a customized frame means (not shown).

Figure 6:
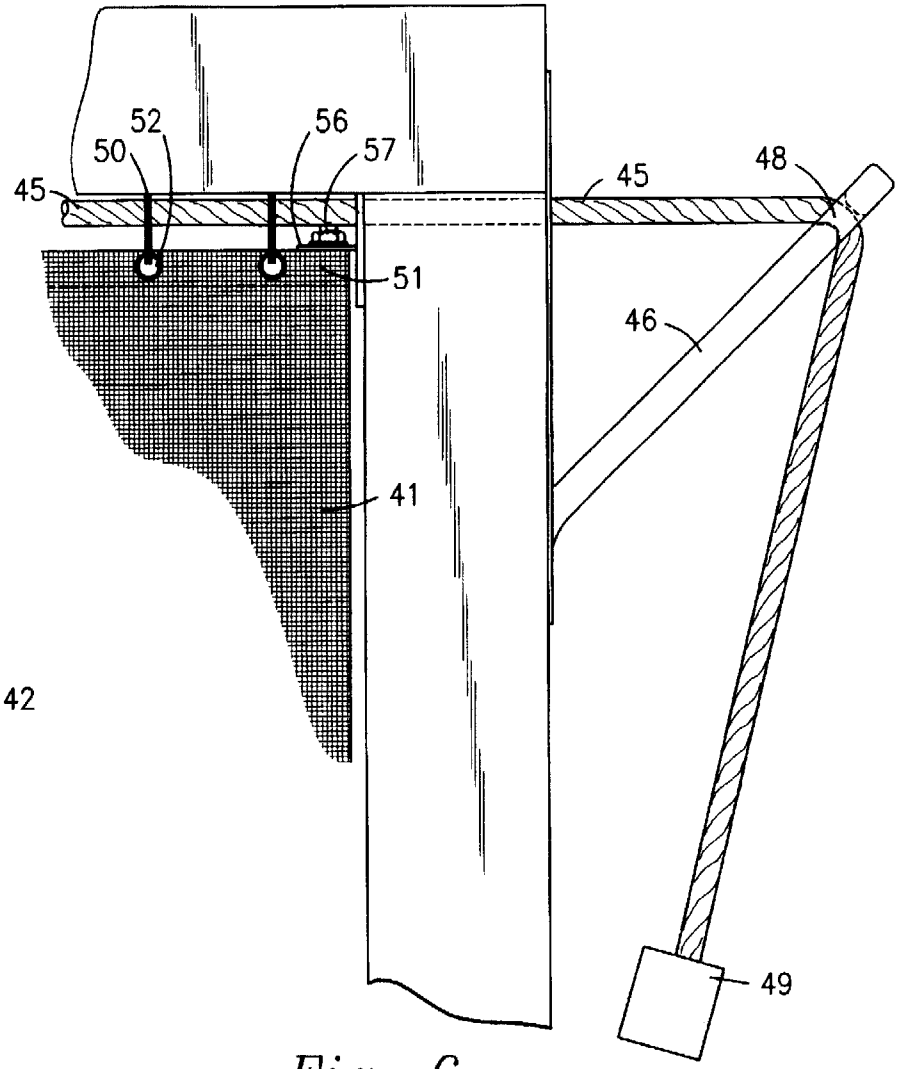
FIG. 6 is a plain view of second embodiment of a decorative screen assembly, hung from a cable support, utilizing a holding bracket adjustable nut means to decrease slack in the decorative screen.
Figure 5:
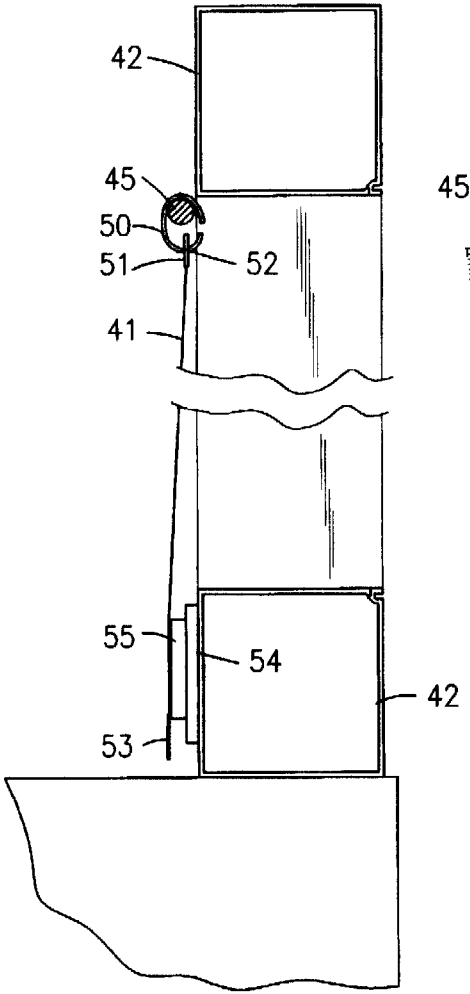
FIG. 5 is a cross-sectional view of a second hanging embodiment of a decorative screen assembly, hung from a support cable.
Figure 7:
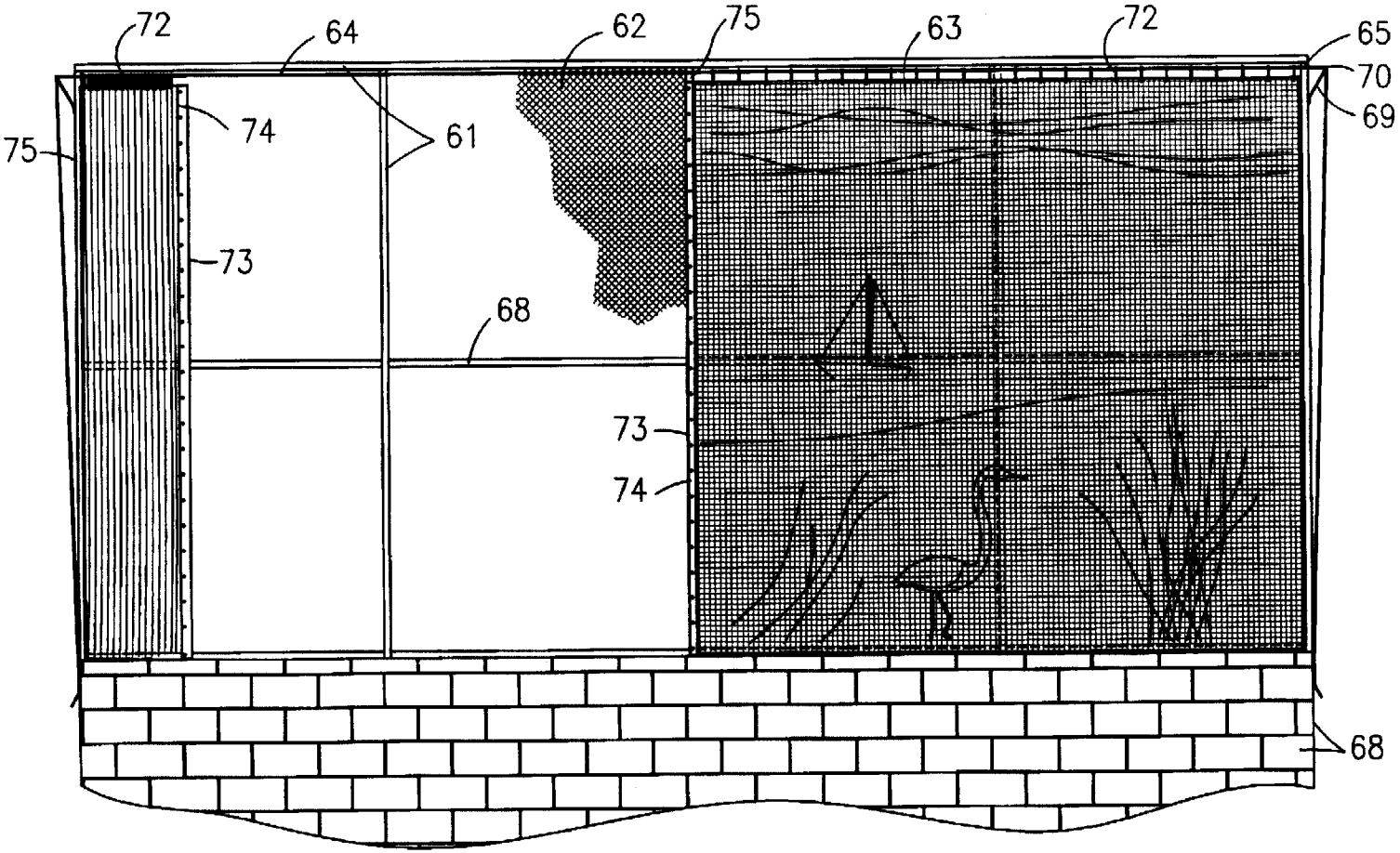
FIG. 7 is a plain view of alternative embodiment of a decorative screen assembly, with the screen shown in both an extended and retracted position, hung from a cable support.

FIGS. 5–7 illustrate alternative installation approaches for the decorative screen of the current invention. FIG. 5 shows a typical pool enclosure structure currently available utilizes aluminum horizontal, vertical, and base support poles 42. These support poles 42 hold the permanent pool screen or mosquito netting 43. Utilizing these pre-existing supports, the decorative screen of the present invention 41 may be suspended from a cable 45 which runs the entire length of the enclosure structure. FIG. 6 shows how the cable 45 may be attached by braces 46, which are mounted on the support poles 42 by means of a baseplate 47, these braces extend several inches outside the enclosure, thereby permitting the decorative screen to be freely slidable and function separately from the underlying enclosure structure. The cable 45 which supports the decorative screen 41 is threaded through a through-hole 48 defined in the brace 46 and firmly secured to an outside wall or foundation 49.

FIGS. 5 and 6 illustrate how the decorative screen 41 is attached to the cable 45 by means of hanging hardware 50 that passes through the grommets 52 defined in the reinforced top edge 51 of the decorative screen. The hanging hardware 50 is designed to release from the cable 45 under strong wind conditions thereby preventing damage to the screen assembly frame.

FIG. 5 illustrates a releasable fastener to aid in holding the bottom edge 53 of the screen in place. A metal strip 54 may be coupled to the base of the enclosure frame such that a covered magnet 55 integrated therein will hold the screen in place during moderate wind conditions so that the screen will remain in a taut position and the decorative pattern will be readily visible.

Optionally (FIG. 6), the hanging hardware may be modified so that slack in the decorative screen may be adjusted by utilizing a holding bracket 56 and adjustable nut assembly 57. The bracket and adjusting nut may have opposing angle pins and sockets, or the equivalent, to allow the nut to turn in only one way.

FIG. 7 illustrates an additional way in which the decorative screen may be suspended from a cable. FIG. 7 shows a typical side wall of a screen enclosure with a frame means 61 supporting the permanent screen 62. The decorative screen 63 is shown full height, alternatively it can be the height of a middle cross support 68. The cable 64 which suspends the decorative screen 63 is held taut by extending the cable out past the support frame 65 through an eye 70 which is mounted on a reinforced strut 69. The cable is anchored into the ground or foundation 68 and runs the entire length of the enclosure structure.

Again, the decorative screen is attached to the cable by hanging hardware means 72. The left edge of the screen 73 is kept rigid, especially during sliding, by means of a rigid vertical member 74 that is formed into the decorative screen. The decorative screen is held closed by hooking, snapping, or otherwise attaching the left edge to a support pole 75.

Figure 8:
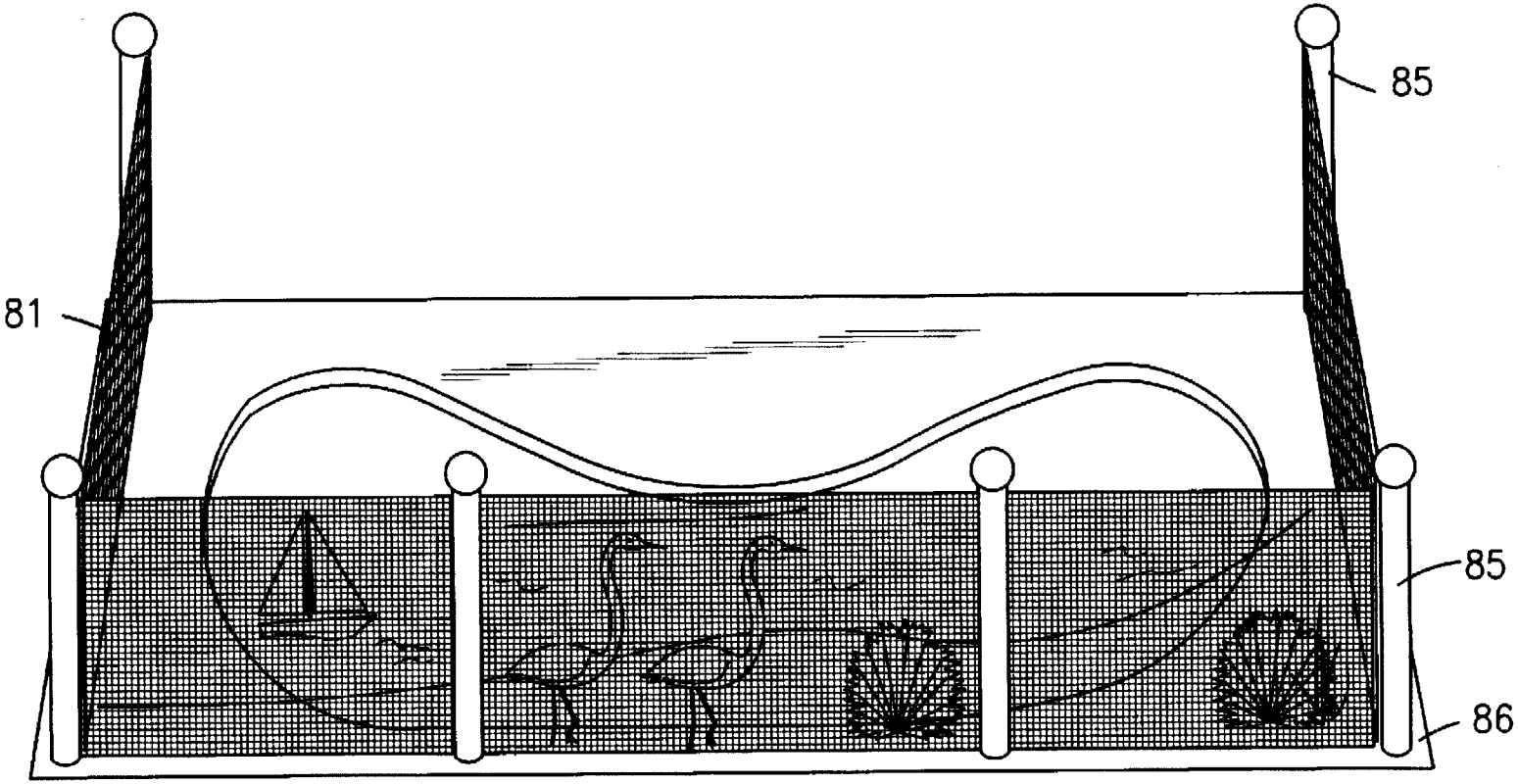
FIG. 8 is a plain view of a third embodiment of the present invention where the decorative screen is anchored to free standing support poles.

In FIG. 8 the decorative screen is installed by pulling the base fencing material 81 tight and anchoring it to support posts 85 placed at regular intervals along the support substrate 86.

Although this invention has been described in its preferred form with a certain degree of particularity with respect to a decorative curtain for increasing privacy, it is understood that the present disclosure of the preferred form has been made only by way of example and that numerous changes in the details of structures and the composition of the system may be resorted to without departing from the spirit and scope of the invention.

Now that the invention has been described,

What is claimed is:

1. A privacy screen assembly, comprising:

a decorative screen, said decorative screen including upper and lower edges, first and second sides, and left and right edges, wherein said decorative screen comprises a base screen and a decorative pigmented coating;

frame means for supporting said decorative screen in a vertical planar orientation; and attachment means by which said decorative screen may be attached to said frame means, wherein said decorative pigment coating is provided on at least said first side and comprises at least two different colors, said different colors cooperating to define a reflected pattern in said decorative screen when viewed from said first side, such that the light reflective and absorptive properties of the decorative pattern viewed from said first side decrease the ability of a viewer to view activities or persons on the opposite side of the screen.

2. A privacy screen assembly as in claim 1, wherein said decorative pigmented coating comprises at least three different colors, said different colors cooperating to define a reflected pattern in said decorative screen.

3. A privacy screen assembly as in claim 1, wherein said decorative pigmented coating comprises at least two coating materials of different reflectivity, said materials of different reflectivity cooperating to define a reflected pattern in said decorative screen.

4. A privacy screen assembly as in claim 1, wherein said decorative pigmented coating comprises at least three coating materials of different reflectivity, said materials of different reflectivity cooperating to define a reflected pattern in said decorative screen.

5. A privacy screen assembly as in claim 1, wherein said base screen material is of uniform mesh size, and wherein said decorative pigmented coating is applied to said base screen material in at least two different coating thicknesses, said different coating thicknesses cooperating to define a reflected pattern in said decorative screen.

6. A privacy screen assembly as in claim 1, wherein said base screen material is of uniform mesh size, and wherein said decorative pigmented coating is applied to said base screen material in at least three different coating thicknesses, said different coating thicknesses cooperating to define a reflected pattern in said decorative screen.

7. A privacy screen assembly as in claim 1, wherein said base screen material is of uniform mesh size, and wherein said decorative pigmented coating is applied to said base screen material in at least three different coating thicknesses, said different coating thicknesses cooperating to define a transmitted pattern in said decorative screen.

8. A privacy screen assembly as in claim 1, wherein said decorative coating material is selected from the group consisting of polymerized polyvinyl chloride resins, copolymerized polyvinyl chloride resins, and acrylic enamel.

9. A privacy screen assembly as in claim 8, wherein said coating material is selected from the group consisting of a phosphate plasticizer, a phthalate ester plasticizer, an ultraviolet absorber, and a fungicide.

10. The privacy screen assembly as in claim 1, wherein said base screen is constructed of a material selected from the group consisting of fiberglass, nylon, and polyester.

11. A privacy screen as in claim 1, wherein said screen is releasably affixed to said frame means with releasable fasteners having a release pressure of 2 pounds or less.

12. A privacy screen assembly as in claim 1, wherein the base hue of said base screen selected from the group consisting of black, white, gray, charcoal, dark green, bronze or aquamarine.

13. A privacy screen assembly as in claim 1, wherein said pattern in said decorative screen comprises a sports logo.

14. A privacy screen assembly as in claim 1, wherein said pattern in said decorative screen comprises a nature scene.

15. A privacy screen assembly as in claim 1, wherein said pattern in said decorative screen comprises a city landscape.

16. A privacy screen assembly comprising:

a decorative screen, said decorative screen including upper and lower edges, first and second sides, and left and right edges, wherein said decorative screen comprises a base screen and a decorative pigmented coating;

frame means for supporting said decorative screen in a vertical planar orientation; and attachment means by which said decorative screen may be attached to said frame means; and means to attenuate the ambient light on said second side of said screen, wherein said base screen material is of uniform mesh size, and wherein said decorative pigmented coating is applied to said base screen material in at least two different coating thicknesses, said different coating thicknesses cooperating to define a transmitted pattern in said decorative screen when viewed from said first side forming a decorative pattern decreasing the ability of a viewer to view activities or persons on the second side of the screen, yet enabling a viewer on the second side of the screen to view activities or persons on the first side of the screen.

17. A method for increasing privacy in a residential area, said method comprising:

(a) defining a privacy area to be screened from public view;

(b) providing along at least a part of the perimeter of the area to be screened a decorative privacy screen assembly comprising:

a decorative screen, said decorative screen including upper and lower edges, left and right edges, a side facing the public and a side facing the privacy area, wherein said decorative screen comprises a base screen and a polychromatic decorative pigmented coating forming a scene or pattern on the side facing the public;

frame means for supporting said decorative screen in a vertical planar orientation; and attachment means by which said decorative screen may be attached to said frame means, and (c) ensuring that the amount of ambient light impinging on the screen from the side visible to the public is greater than the amount of light impinging on the screen from the side facing the privacy area, such that the light reflective and absorptive properties of the decorative pattern decrease the ability of a viewer on the side of the screen facing the public to view activities or persons on the opposite side of the screen.

18. A method as in claim 17, wherein said residential area is a pool area.

19. A method as in claim 17, wherein said area is a patio area.

* * * * *